US007707913B2

(12) United States Patent
Halse

(10) Patent No.: US 7,707,913 B2
(45) Date of Patent: May 4, 2010

(54) METHOD OF DISCONNECTING A PIPE LENGTH

(75) Inventor: Helge-Ruben Halse, Kristiansand S. (NO)

(73) Assignee: V-Tech AS, Kristiansand (NO)

( * ) Notice: Subject to any disclaimer, the term of this patent is extended or adjusted under 35 U.S.C. 154(b) by 43 days.

(21) Appl. No.: 10/582,378

(22) PCT Filed: Dec. 10, 2004

(86) PCT No.: PCT/NO2004/000380

§ 371 (c)(1),
(2), (4) Date: Aug. 31, 2006

(87) PCT Pub. No.: WO2005/056975

PCT Pub. Date: Jun. 23, 2005

(65) Prior Publication Data

US 2007/0079671 A1 Apr. 12, 2007

(30) Foreign Application Priority Data

Dec. 11, 2003 (NO) ..... 20035508

(51) Int. Cl.
*B25B 17/00* (2006.01)

(52) U.S. Cl. ..... 81/57.16; 81/57.15; 81/57.17; 81/57.18; 81/57.19; 81/57.2; 81/57.21

(58) Field of Classification Search ..... 81/57.15, 81/57.16, 57.17, 57.18, 57.19, 57.2, 57.21
See application file for complete search history.

(56) References Cited

U.S. PATENT DOCUMENTS

| | | | | |
|---|---|---|---|---|
| 2,668,689 | A * | 2/1954 | Cormany | 81/57.16 |
| 3,838,613 | A * | 10/1974 | Wilms | 81/57.34 |
| 3,902,385 | A | 9/1975 | Haby | |
| 4,246,809 | A | 1/1981 | Keast et al. | |
| 4,979,356 | A | 12/1990 | Vatne | |
| 5,060,542 | A * | 10/1991 | Hauk | 81/57.34 |
| 6,223,629 | B1 | 5/2001 | Bangert | |
| 6,505,531 | B2 * | 1/2003 | Stogner | 81/57.16 |
| 2003/0056623 | A1 * | 3/2003 | Carlson | 81/57.16 |

FOREIGN PATENT DOCUMENTS

WO WO 01/49968 7/2001

OTHER PUBLICATIONS

Written Opinion, Apr. 25, 2005.

* cited by examiner

*Primary Examiner*—Bryan R Muller
(74) *Attorney, Agent, or Firm*—Gable Gotwals

(57) ABSTRACT

A method of using a power tong (2) for use in the pipe make-up and pipe break-out of pipe lengths (22) during drilling in the ground as it is known from, for example, the recovery of petroleum, the power tong (2) being part of an assembly (1) which includes a back-up tong (4) movable relative to the power tong (2) in the longitudinal direction of the pipe length (22), and at least one guide column (10). The tong is releasably connected to a chassis and is arranged to be lifted up from a drill floor to a level higher up in order to break out a pipe from a pipe string, should the pipe string get stuck in the borehole.

10 Claims, 4 Drawing Sheets

METHOD OF DISCONNECTING A PIPE LENGTH

CROSS-REFERENCE TO PENDING APPLICATIONS

This application is based on PCT Patent Application No. NO02004/000380, filed on Dec. 10, 2004, which was based on Norwegian Patent Application No. 20035508, filed on Dec. 11, 2003.

This invention relates to a power tong. More particularly, it concerns a power tong with no radial opening, the power tong being particularly suitable for use in making up pipes during drilling in the ground as it is known from the recovery of petroleum, for example. The tong is releasably connected to a chassis and is arranged to be lifted up from a drill floor to a level higher up in order to break out a pipe from a pipe string. The invention also includes a method for the use of the power tong.

From the recovery of petroleum, among other things, it is known to use power tongs for making up and breaking out pipe lengths into or from a pipe string in connection with a drilling rig. It is common to use mechanized pipe tongs, which are moved, after a pipe connection has been screwed or unscrewed, essentially horizontally away from the pipe string, the pipe string being at the drilling center of the drilling rig.

Such a method presupposes that the power tong must be provided with a radial opening, whereby the power tong can be moved in the horizontal plane as it is removed from the pipe string.

It is obvious that a radial opening of this kind in a power tong that must be able to rotate about the longitudinal axis of the pipe, complicates the structure of the power tong. The opening weakens, to a substantial degree, the structure encircling the pipe. A consequence of this is that the construction will have to be dimensioned up in order to be able to absorb the relatively great forces which are transferred between the power tong and the pipe string. A relatively complicated mechanical device has to be applied to close the radial opening when the power tong is in use, and also in many cases in order to transfer forces between the side portions of the opening.

It is also known to use power tongs without a radial opening for work of this kind. Power tongs having no radial opening can be formed with a complete non-segmented drive ring which encircles the pipe string. When a power tong of this kind is not in use, it can be lowered down towards the slips and rotary table of the drilling device.

However, the fact that the power tong encircles the pipe string, may be a drawback if the pipe string gets stuck in the borehole immediately after a new pipe length has been connected in the pipe string. In some cases, in which it is not possible to pull the pipe string sufficiently up for the newly made up pipe length to be broken out, it has been necessary to cut the pipe string to be able to remove the power tong.

The invention has as its object to remedy or reduce at least one of the drawbacks of the prior art.

The object is realized according to the invention through the features specified in the description below and in the following claims.

A power tong according to the invention is provided with a non-divided drive ring encircling the vertical central axis of the drilling center and pipe string. The drive ring has been given a relatively large internal diameter in order for, for example, a drilling tool of a considerably larger external diameter than the pipe string to be moved through the power tong.

The drive ring is rotatably supported in the housing of the power tong and is preferably driven, in a manner known in itself, by means of at least one hydraulic motor.

In the drive ring there is arranged at least one pressure-fluid-driven radially movable clamping device (jaw). Most preferably, a number of jaws are distributed round the pipe in two groups. Each jaw group is releasably connected to the drive ring, each jaw group being arranged to be lifted out of the drive ring, for example in connection with maintenance or when a larger object is to be moved through the power tong.

At their portions bearing on the pipe, the jaws are preferably provided with replaceable grippers. Sets of grippers can be produced in different dimensions and designs, so that they can be adapted for the relevant pipe dimension and the desired engagement geometry between the gripper and the pipe string.

Most preferably, the power tong is formed by an upper assembly tong in an assembly with an underlying back-up tong. The assembly is connected by means of vertical guide columns to a horizontally movable chassis to allow the assembly to be moved away from the drilling center.

The power tong and the back-up tong are relatively movable in height in order to compensate for the relative axial movement of the pipes during make-up and break-out, and in order to allow work to be carried out between the tongs. It is advantageous that between the power tong and the back-up tong weight-compensating cylinders are arranged for load to be absorbed during make-up of sensitive threads.

The vertical guide columns are releasably connected to the chassis. Should a situation arise, in which a pipe length will have to be disconnected from the pipe string, and in which the closest accessible connection point is located at a level higher up than the normal work area of the power tong, the guide columns can be disconnected from the chassis and be locked into the back-up tong, for example. The assembly of a power tong, back-up tong and guide columns is then lifted up to the connection point of the pipe length, for example by means of so-called tugger winches.

During a break-out operation, in which the back-up tong clamps the lower sleeve portion of the connection point and the power tong clamps an upper sleeve portion, the guide columns absorb the torque arising between the tongs.

After the pipe length has been disconnected from the pipe string, the assembly may be removed, the pipe string may be released according to methods known in themselves.

The back-up tong may with advantage be provided with a traversing lifting device on its underside, for example in order to lift out the slips and similar.

Relative to the prior art, the time that it takes to make up and break out pipes can be reduced, as the time for moving the power tong to and from the drilling center will no longer be needed. The relatively simple construction of the power tong entails improved reliability and lower maintenance expenses.

All spinning and power operations are carried out by means of the tong and, thus, it is not necessary to use a separate so-called spinning unit.

The construction is compact and builds relatively little longitudinally of the pipe string. It is suitable for integrating cleaning and lubricating equipment for the threads of the pipe lengths.

In what follows will be described a non-limiting example of a preferred embodiment and method which are visualized in the accompanying drawings, in which.

Figure 1:
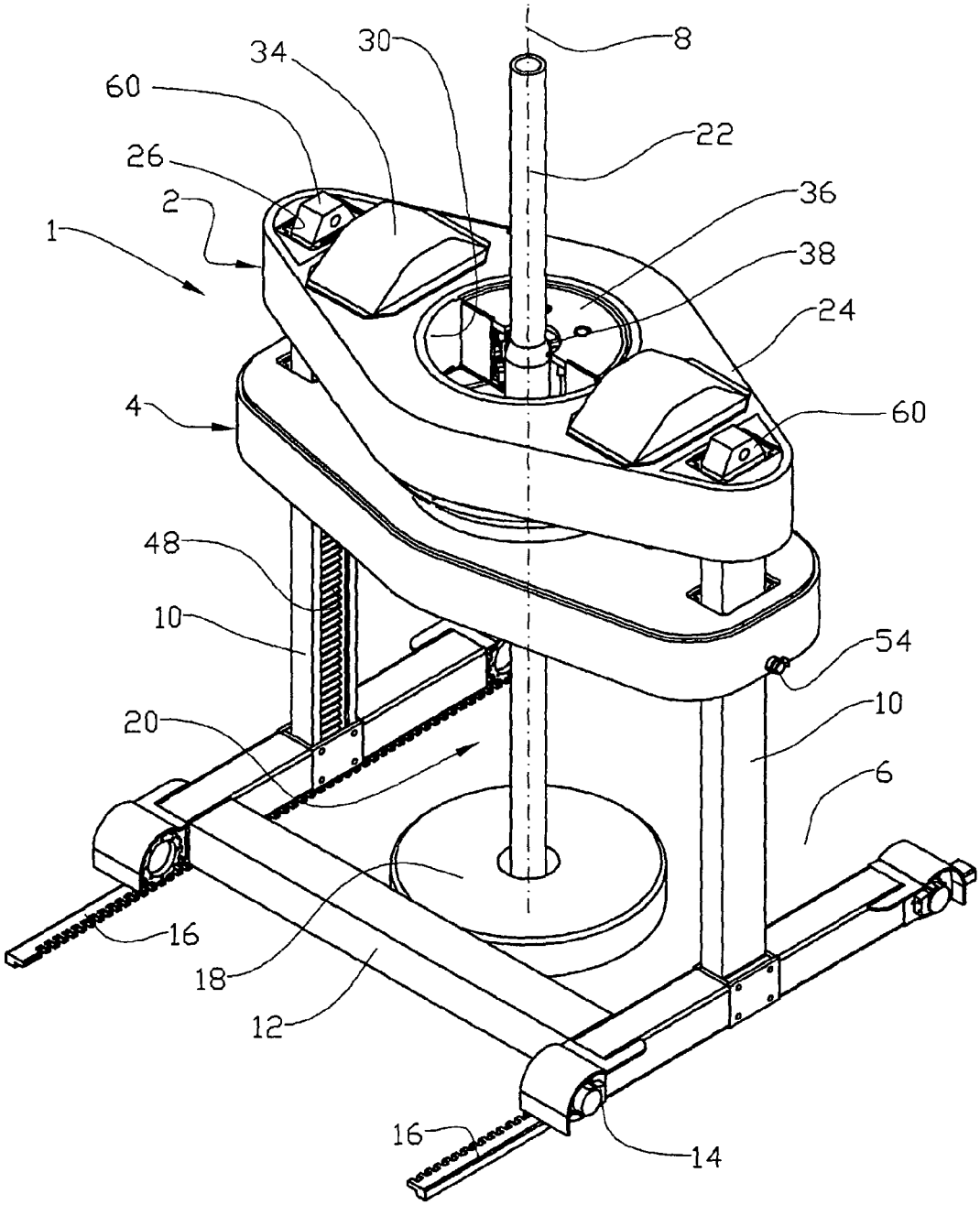
FIG. 1 shows in perspective an assembly of a power tong, in which a jaw group has been removed for illustrative reasons, and a back-up tong on a horizontally movable chassis, the assembly having been moved into its upper position.

In the drawings the reference numeral 1 identifies an assembly of a power tong 2 and a back-up tong 4 located on a drilling rig 6, coaxially to the drilling center 8 of the drilling rig 6. The assembly 1 is connected, vertically movable, to two diametrically opposite guide columns 10 relative to the drilling center 8.

The guide columns 10 are releasably connected to a chassis 12, which is horizontally movable by means of wheels 14 and hydraulic motors, not shown, on rails 16 connected to the drilling rig 6.

In its active position the assembly 1 is thus just above the slips 18 of the drilling rig 6, a pipe string 20 extending up through the slips 18 and further up through the assembly 1. The pipe string 20 is formed by pipe lengths 22 screwed together.

The power tong 2 includes a power tong housing 24 which is provided with a through guide 26 corresponding to the guide columns 10, and a supported, undivided drive ring 30.

The drive ring 30 is rotated about the drilling center 8 by means of two hydraulic motors 34.

In the drive ring 30 and co-rotating therewith, are arranged two crescent-shaped jaw groups 36, only one of which is illustrated in the drawings for illustrative reasons.

Each jaw group 36 is typically provided with three hydraulically movable jaws 38 distributed about the well center 8.

Figure 2:
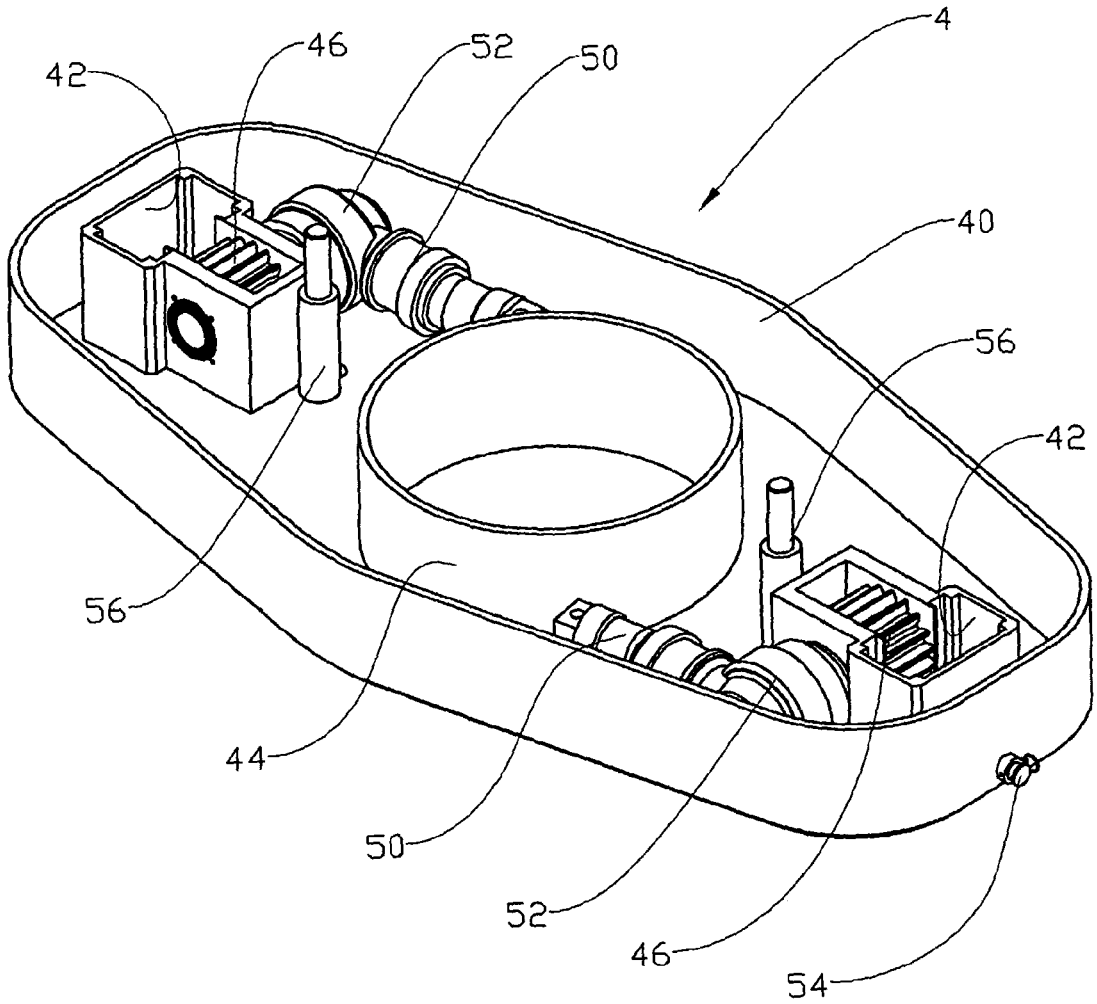
FIG. 2 shows, on a larger scale, a back-up tong from which an upper cover has been removed.

The back-up tong 4, see FIG. 2, comprises a back-up tong housing 40 with guides 42 corresponding to the guide columns 10, and a supporting ring 44 for two not shown jaw groups. At the guides 42 are arranged cogwheels 46 engaging the respective pitch racks 48 of the guide columns 10.

The cogwheels 46 are each driven by a respective hydraulic motor 50 via gears 52, and the guide columns 10 are arranged to be locked into the back-up tong housing 40 by means of corresponding locking mandrels 54 movable in the back-up tong housing 40.

A pair of hydraulic cylinders 56 are arranged to adjust the vertical distance between the power tong 2 and the back-up tong 4.

When a pipe length 22 is to be joined to the pipe string 20, the assembly 1 is moved vertically on the guide columns 10 by means of the hydraulic motors 50, gears 52, cogwheels 46 and pitch racks 48 until, in a known manner, the back-up tong 4 corresponds with the upper sleeve portion, not shown, of the pipe string 20. The vertical distance between the back-up tong 4 and the power tong 2 is adjusted in such a way that the jaw groups 36 correspond with the lower sleeve portion of the pipe length 22.

The jaws 38 are moved towards the pipe length 22 by means of pressurized fluid, thereby gripping their respective pipe portions as the hydraulic motors 34 rotate the drive ring 30 and the jaw groups 36 about the drilling center 8.

The power tong 2 is moved down towards the back-up tong 4 as the make-up proceeds.

After the desired tightening torque has been achieved, the rotation of the drive ring 30 is stopped and the jaws 38 are withdrawn.

Figure 3:
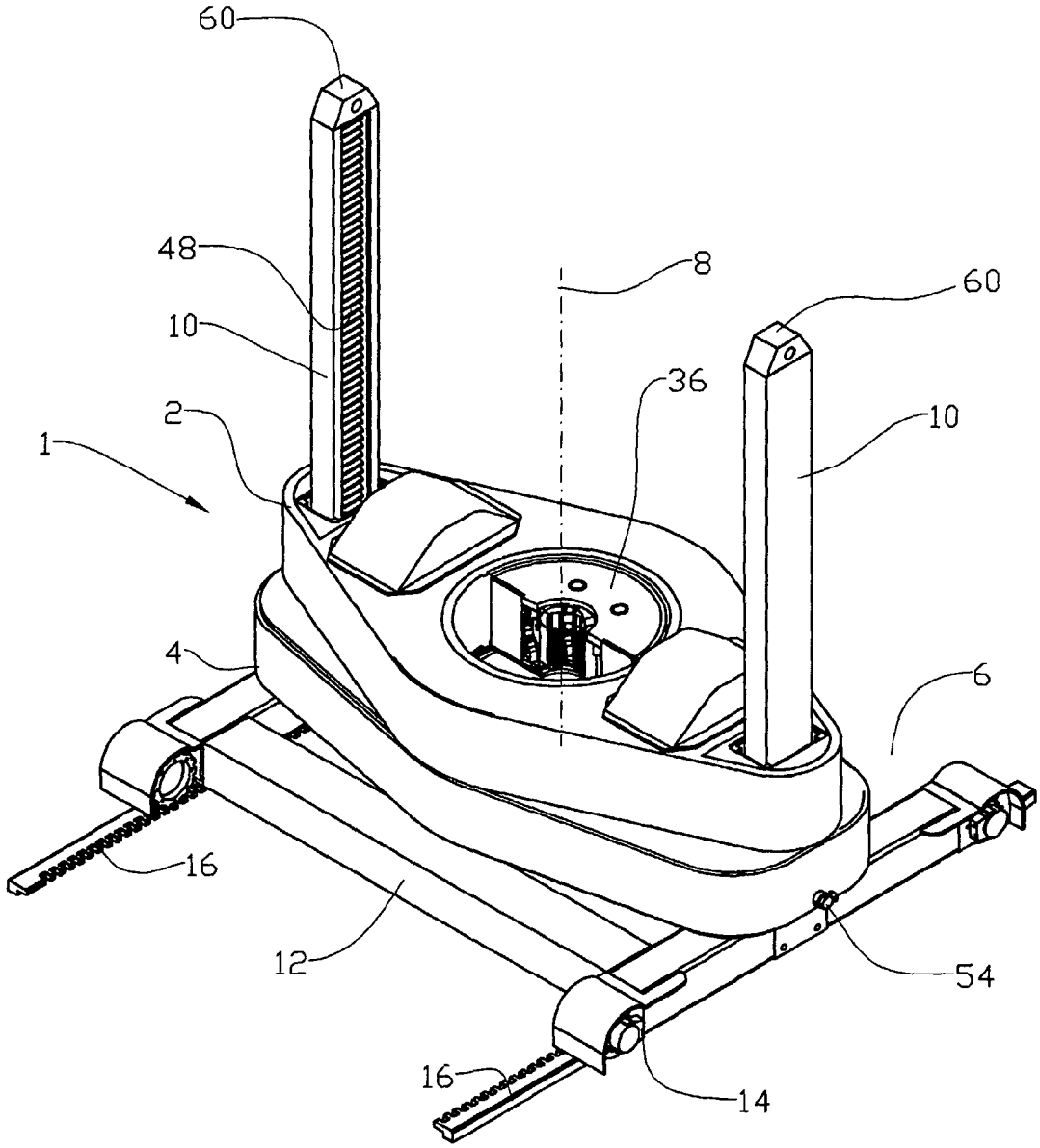
FIG. 3 shows the same as FIG. 1, but here the assembly is in its lower position.
Figure 4:
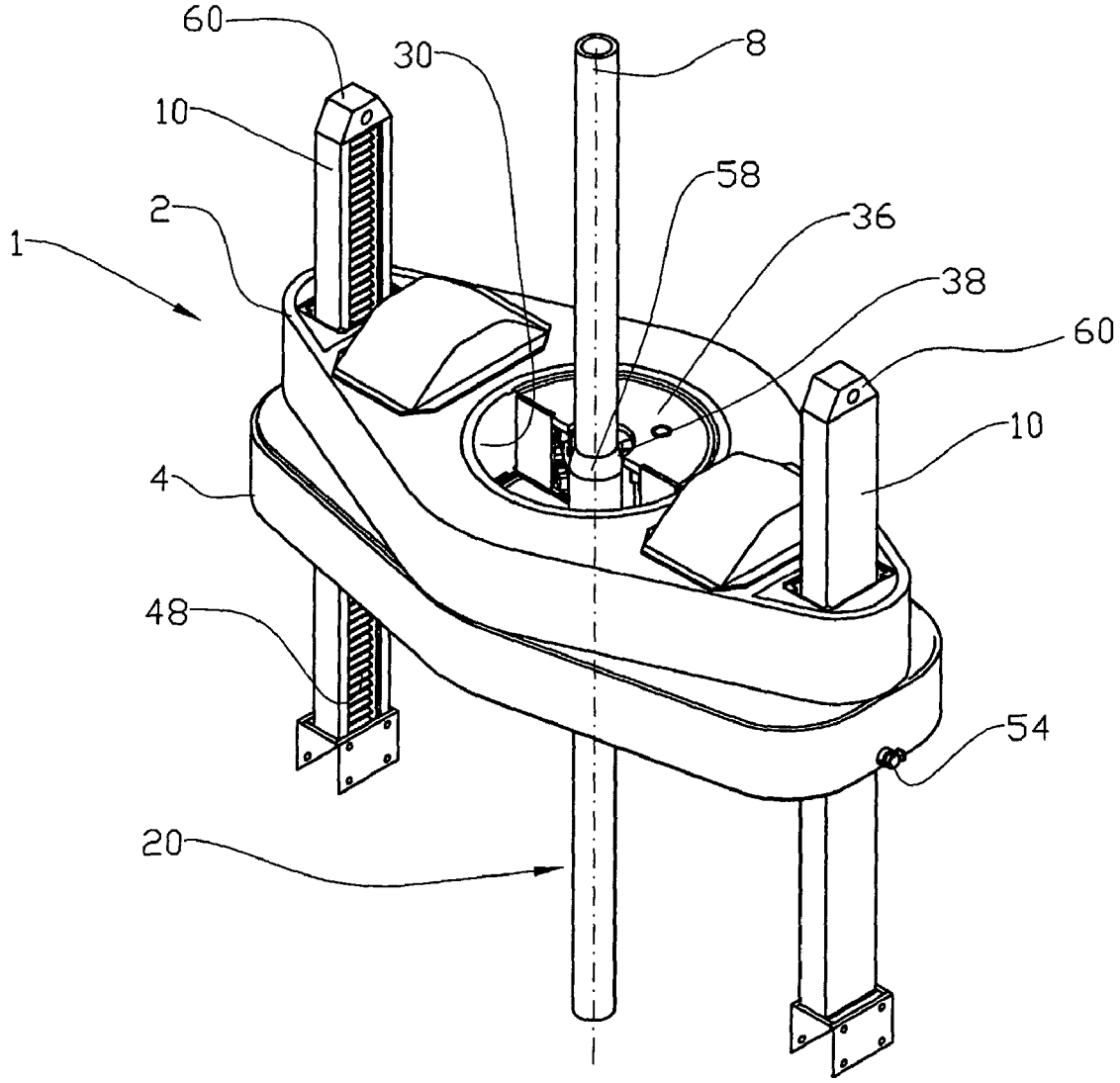
FIG. 4 shows the assembly during the break-out of a pipe length from the pipe string, the break-out point being at a level higher up than the normal work area of the power tong.

The assembly 1 is thereby disengaged from the pipe string 20 and may, if desired, be moved into its lower position, see FIG. 3.

When a pipe length 22 is to be broken out of the pipe string 20, the operation is carried out in reverse order in a manner corresponding to that described above.

If drilling tools or other objects having larger external diameters than the pipe string 20, are to be moved through the assembly 1, the jaw groups 36 can relatively easily be lifted out of the drive ring 30.

Should the pipe string 20 get stuck, so that the upper pipe length 22 will have to be unscrewed from the pipe string 20 while the nearest accessible pipe joint is at a level higher up than the normal work area of the assembly 1, the guide columns 10 are disconnected from the chassis 12 and locked into the back-up tong 4 by means of the locking mandrels 54. The assembly 1 of a power tong 2, back-up tong 4 and guide columns 10 is then lifted up to the connecting point 58 of the pipe length 20, for example by means of not shown tugger winches and lifting lugs 60.

During the break-out operation, in which the back-up tong 4 clamps the lower sleeve portion of the connecting point 58 and the power tong 2 clamps the upper sleeve portion of the connecting point 58, the guide columns 10 absorb the torque that arises between the tongs 2, 4. It is advantageous that the guide columns 10 are positioned on diametrically opposite sides of the well center 8 in order to absorb the torque in the best possible way.

When the pipe length 22 is unscrewed from the pipe string 20, the assembly 1 may be removed from the drilling center 8.

The invention claimed is:

1. A method for connecting and disconnecting a pipe length from a pipe string, the method comprising:

providing a chassis;

providing an assembly comprising a power tong, a back-up tong, one or more guide columns with a pitch rack, one or more cogs, one or more hydraulic cylinders and a work area, wherein the power tong and back-up tong are movable relative to each other through operation of the hydraulic cylinder, the power tong and back-up tong are movable along the one or more guide columns through operation of the one or more cogs along the pitch rack and the chassis is removably connected to the one or more guide columns;

providing a pipe length;

encircling the pipe length with an angularly non-segmented drive ring of the power tongs carrying one or more semicircular shaped jaws;

encircling the pipe string with an angularly non-segmented housing of the back-up tongs;

securing the pipe length to the pipe string having a connecting point defined at the point where the pipe length is secured to the pipe string;

disconnecting the one or more guide columns from the chassis; and adjusting the height of the assembly to place the connecting point in the work area of the assembly; providing a mandrel movably mounted in the back-up tong housing to lock the back-up tong relative to the one or more guide columns; and locking the back-up tong to the one or more guide columns.

2. The process of claim 1 further comprising:

securing the power tong to the pipe length above the connecting point;

securing the back-up tong to the pipe string below the connecting point; and rotating the pipe length.

3. The process of claim 2 further comprising moving the power tong and the back-up tong relative to one another.

4. The process of claim 3 further comprising:

removing the pipe length from the pipe string;

removing the power tong from the pipe length;

removing the back-up tong from the pipe string; and moving the assembly relative to the pipe string.

5. A method for connecting and disconnecting a pipe length from a pipe string, the method comprising:

providing a chassis;

providing an assembly comprising a power tong, a back-up tong, one or more guide columns with a pitch rack, one or more cogs, one or more hydraulic cylinders and a work area, wherein the power tong and back-up tong are movable relative to each other through operation of the hydraulic cylinder, the power tong and back-up tong are movable along the one or more guide colunms through operation of the one or more cogs along the pitch rack and the chassis is removably connected to the one or more guide columns;

locking the back-up tong to the one or more guide columns by engaging a mandrel between the back-up tong and the one or more guide columns;

providing a pipe length;

securing the pipe length to a pipe string having a connecting point defined at the point where the pipe length is secured to the pipe string;

disconnecting the one or more guide columns from the chassis; and adjusting the height of the assembly to place the connecting point in the work area of the assembly.

6. The process of claim 5 further comprising:

securing the power tong to the pipe length above the connecting point;

securing the back-up tong to the pipe string below the connecting point; and rotating the pipe length.

7. The process of claim 6 further comprising moving the power tong and the back-up tong relative to one another.

8. The process of claim 7 further comprising:

removing the pipe length from the pipe string;

removing the power tong from the pipe length;

removing the back-up tong from the pipe string; and moving the assembly relative to the pipe string.

9. The process of claim 8 further comprising: encircling the pipe length with an angularly non-segmented drive ring of the power tongs.

10. The process of claim 8 further comprising: encircling the pipe string with an angularly non-segmented housing of the back-up tongs.

* * * * *